US007001289B1

(12) United States Patent
Polega

(10) Patent No.: US 7,001,289 B1
(45) Date of Patent: Feb. 21, 2006

(54) VOLLEYBALL TRAINING APPARATUS

(76) Inventor: Timothy Polega, 2824 S. 11th St., Niles, MI (US) 49120

( * ) Notice: Subject to any disclaimer, the term of this patent is extended or adjusted under 35 U.S.C. 154(b) by 0 days.

(21) Appl. No.: 10/906,555

(22) Filed: Feb. 24, 2005

(51) Int. Cl.
*A63B 69/00* (2006.01)

(52) U.S. Cl. ..... 473/459; 473/473

(58) Field of Classification Search ..... 473/459, 473/473
See application file for complete search history.

(56) References Cited

U.S. PATENT DOCUMENTS 4,161,313 A 7/1979 Dickey
4,352,494 A 10/1982 Wells
4,798,390 A * 1/1989 Dooley ..... 473/459
4,881,742 A 11/1989 Hargreave
4,948,150 A 8/1990 Daly et al.
5,520,397 A 5/1996 Thompson
5,660,395 A 8/1997 Marshall
5,755,631 A * 5/1998 Paschka ..... 473/459
5,792,014 A 8/1998 Brown
5,913,739 A 6/1999 Barenneisen
6,672,979 B1 1/2004 Barenneisen

* cited by examiner

*Primary Examiner*—Raleigh W. Chiu
(74) *Attorney, Agent, or Firm*—Leo H McCormick, Jr.

(57) ABSTRACT

An apparatus for teaching a person a technique for striking a volleyball. The apparatus has a chute with first and second side walls for directing volleyball toward a pivotable arm attached to the chute. A passage in the arm connects a cone thereon with a source of vacuum while the weight of a valve on the arm positions the arm in a vertical position. An indexing member sequentially retains volleyballs in the chute and sequentially presents a volleyball to the cone. An input acts to release a lock on the indexing member and thereafter allow a volleyball to roll from the chute toward the cone where the vacuum sucks the volleyball onto the cone. The weight of the volleyball causes the arm to pivot from the vertical position and rotate the volleyball to a position for a player to spike the volleyball.

14 Claims, 5 Drawing Sheets

VOLLEYBALL TRAINING APPARATUS

DESCRIPTION

This invention relates to a volleyball training apparatus that enables a player to practice spiking a volleyball.

BACKGROUND OF THE INVENTION

An optimum technique for spiking a volleyball requires a person to synchronize the approach, timing, jumping, and hand-eye relationship with a specific style swing. It is difficult to teach each aspect necessary to achieve such spiking at one time and as a result it has been suggested that the timing element may be delayed and later added once the other elements have been mastered or at least understood. In an effort to teach about spiking a volleyball and provide training that is necessary for a person to learn various devices and apparatus have been devised. The following patents illustrate examples of such apparatus that may be used in the training of a person to hit a volleyball: in U.S. Pat. No. 6,672,979, a ball is suspended by magnetic attraction above a net and a person hits the ball through a sideways or horizontal action; in U.S. Pat. No. 5,660,395, a ball is held by applying a horizontal force to the sides of a ball and a person may only hit the ball through a vertical action; in U.S. Pat. Nos. 4,881,742 and 4,948,150, a ball is attached to a string tethered to a pole and after a person hits the ball it goes and comes back to approximately the same place; and in U.S. Pat. Nos. 4,161,313 and 4,352,494, a basketball is suspended by vacuum for practicing a jumping maneuver relating to rebounding by pulling the basketball held by a retention head. However for realistic practice, the retention of a volleyball must not interfere with a natural and desired striking location which is at the top of the volleyball and as a person approaches the volleyball from a side. Ideally a retaining force for holding a volleyball should be negligible so as to equate with normal game situations. Unfortunately, in the prior art devices such as defined above, a volleyball is either held in a position where a person may accidentally hit the device, the volleyball is held with a greater force than is experienced in an actual game situation and/or the trajectory after a volleyball is struck evaluated as the volleyball is tied to a string attached to a support. A further example of a training device is disclosed in U.S. Pat. No. 5,520,397 where a volleyball is manually released from a storage basket and allowed to roll down a ramp and when the ball rolls off the ramp, a person strikes the volleyball. While this device allows a person to view the trajectory of the volleyball after being struck to evaluate his jumping and hand-eye coordination each strike involves timing wherein the volleyball is not stationary and is moving while being struck.

SUMMARY OF THE INVENTION

The present invention for use in teaching a process of optimum spiking overcomes many of the short comings of the prior art and is defined by an apparatus that includes an adjustable support that holds a chute through which a volleyball moves to a position for a person to strike the volleyball. The chute has parallel side walls with a basket or storage area for volleyballs on an end and a pivotal arm with a cone on a first end for receiving the volleyball and a valve on a second end weight of which holds the arm in a vertical position with respect to the side walls. The arm has a passage therein connected to a source of vacuum such that air is drawn from the surrounding environment through the cone and valve. An indexing member allows volleyballs from the storage area to sequentially move from the chute onto the cone while the vacuum sucks the volleyball into a sealing relationship with the cone. The weight of the volleyball causes the arm to move from the vertical position to a position that a person may strike the volleyball with a desired force. Once a volleyball is in a sealed relationship on the cone, the vacuum draws air from the surrounding environment through the valve to lower the holding force of the volleyball on the cone. The amount by which the holding force is lowered is controlled by the valve and the size of opening therein with respect to the surrounding environment. The holding force should be selected such that is does not materially interfere with a persons aim capability in striking a volleyball. Once the volleyball has been hit off of the cone, the weight of the valve acts to reposition the arm in the vertical position adjacent the chute and the indexing member allows another volleyball to roll toward the cone for retention thereon and repeat the set of locating a volleyball in a location for a person to jump and strike the volleyball.

An advantage of the invention resides in the ability of repeatable locating a volleyball in a same stationary location to allow a person to practice and make changes in striking a volleyball to achieve a desire result according to an optimum striking process.

The present invention provides an apparatus that holds a volleyball by a vacuum retention and positions the volleyball in a location that does not interfere with a desired hitting motion, i.e. striking the volleyball from the top as a person approaches the volleyball from a side.

DETAILED DESCRIPTION

In the specification where similar components are used the component may be identified by a number or a same number plus ' depending on a relationship with other components.

Figure 1:
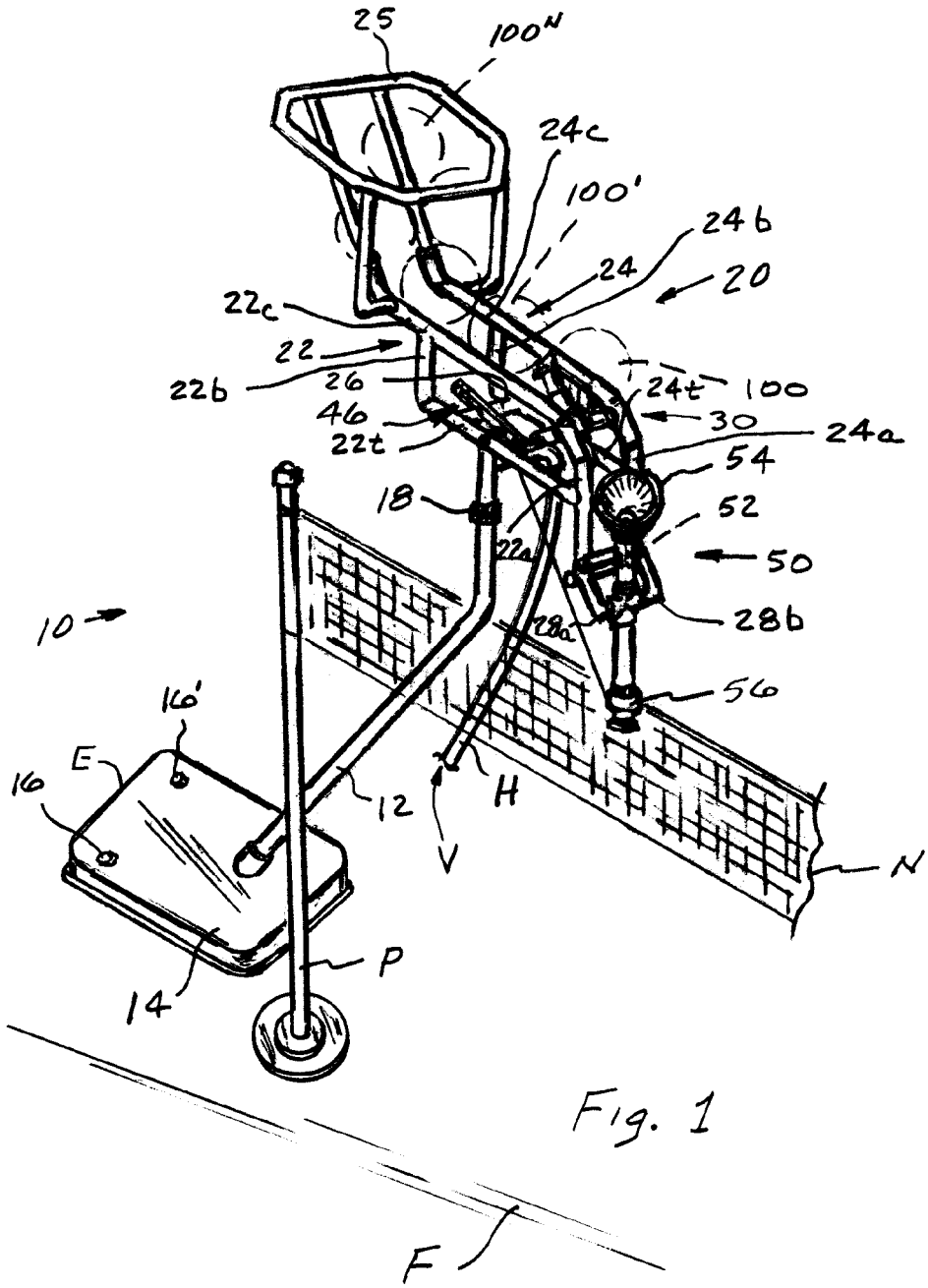
FIG. 1 is a front perspective view of an apparatus, according to the present invention, for allowing a player to practice striking a volleyball.

The apparatus 10 shown in FIG. 1 is made according to the present invention for allowing a person to practice a striking technique of a volleyball by essentially having a same condition repeated until the striking technique is mastered. The apparatus 10 has a chute 20 with first 22 and second 24 side walls for directing a volleyball 100 toward a pivotal arm 50 attached to the chute 20. A passage 52 in the pivotal arm 50 connects a cone 54 thereon with a source of vacuum while the weight of a valve 56 on the pivotal arm 50 positions the pivotal arm 50 in a vertical position. An indexing member 30 sequentially retains volleyballs 100, 100' . . . 100$^n$ in the chute 20 and sequentially presents a volleyball 100 to the cone 54. An input acts to release a lock 46 on the indexing member 30 and thereafter allows a volleyball 100 to roll from the chute 20 toward the cone 54 where the vacuum sucks the volleyball 100 onto the cone 54. The weight of the volleyball 100 causes the pivotal arm 50 to rotate from the vertical position and rotate the volleyball 100 to a location for a player to spike the volleyball 100. Once a volleyball 100 has been struck and removed from the cone 54 the pivotal arm 50 rotates back to the vertical position thanks to the weight of the valve 56 and indexing member 30 thereafter rotates to allow a subsequent volleyball 100' to roll toward the cone 50 to repeat the locating of a volleyball 100' in a location for a person to again repeat a desire striking technique.

In more particular details the chute 20 is supported on a pole 12 that extends from a base 14. The base 14 may have a first adjustment such as screws 16, 16' that are turned to move end E of base 14 off the Floor F. This first adjustment would align the chute 20 in a slight tilt with respect to the horizontal plane of floor F on which the base 14 is located while a second adjustment 18 is located in pole 12 such that height of chute 20 with respect to floor F may be changed with respect to net N attached to pole P.

Figure 2:
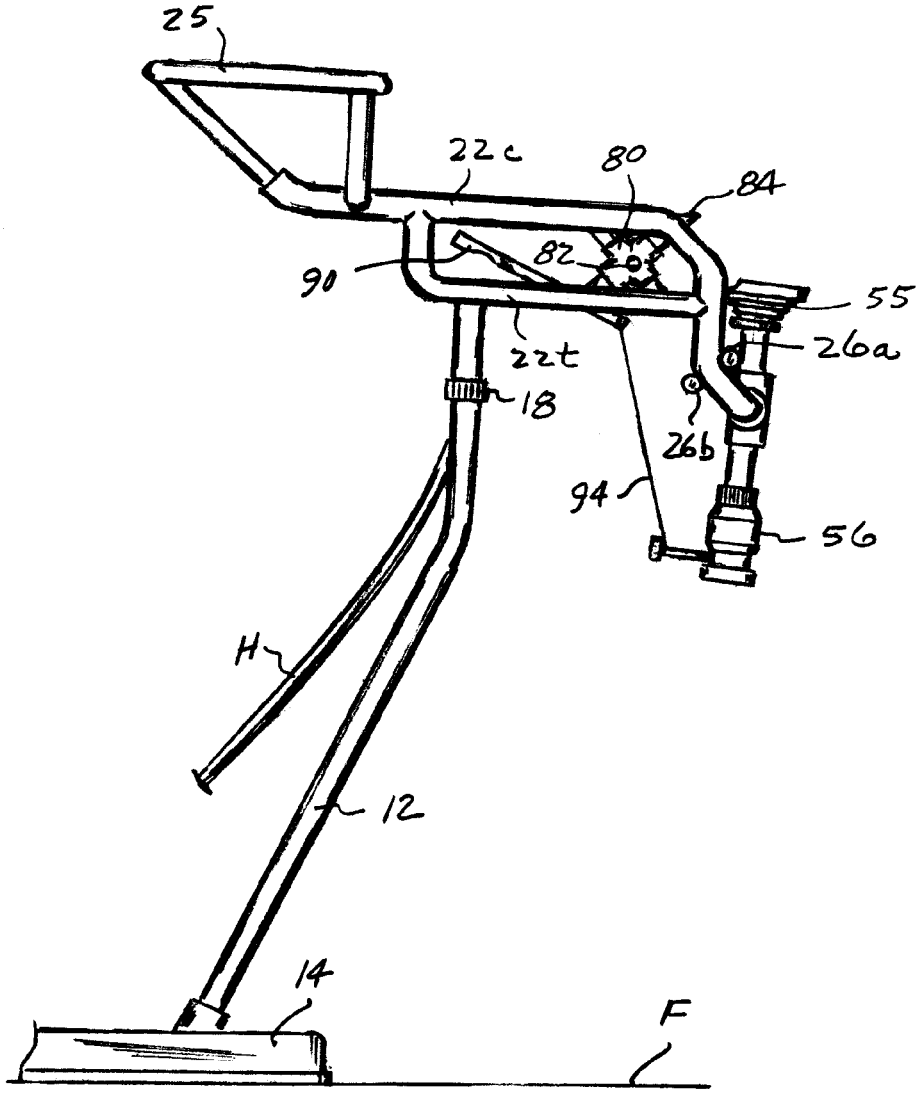
FIG. 2 is a side elevation view of FIG. 1.
Figure 3:
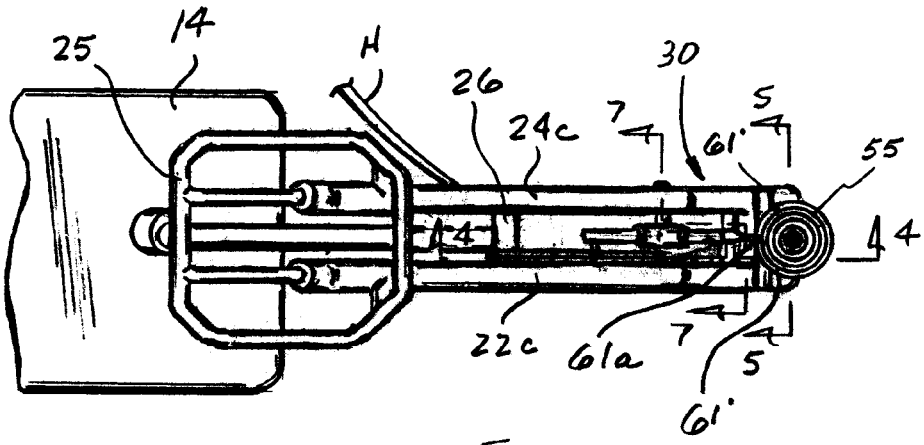
FIG. 3 is a top view of FIG. 2.

Chute 20 is defined by parallel first 22 and second 24 side walls and a base 26 that is attached to pole 12, see FIGS. 2 and 3. The first side wall 22 has a first end 22*a* and second end 22*b* with a first inwardly projecting member 28*a* that extends from the first end 22*a* while the second side wall 24 has a first end 24*a* and a second end 24*b* with a second inwardly projecting member 28*b* that extends from the first end 24*a*. The second ends 22*b* and 24*b* are connected to a hoop member 25 having projections 25*a* and 25*b* thereon that are respectively connected to first 22 and second 24 sidewalls to form a crib or storage basket for the plurality of volleyballs 100,100' . . . 100$^n$. The base 26 and spacers 26*a* and 26*b* have a width such that the first 22 and second 24 side walls are spaced apart a distance such that a volleyball 100 is retained there between and yet may roll from the second end toward the first end of the chute 20 toward the pivotal arm 50. In addition, the base 26 and at least one of the lower tubes 22*t*, 24*t* of the first 22 and second 24 side walls are connected to a source of vacuum available through flexible hose H and at least one of the inwardly projecting members 28*a*, 28*b*.

Figure 5:
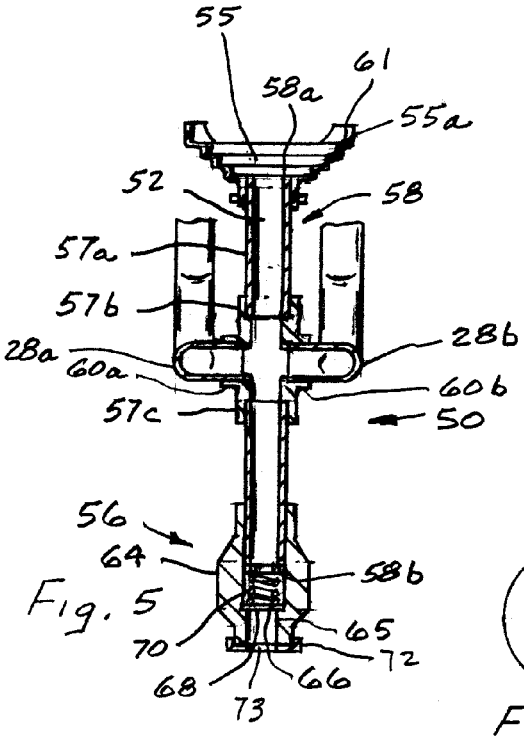
FIG. 5 is a sectional view taken along lines 5—5 of FIG. 3 showing an arm that pivots with respect to the sidewalls of a chute.

The pivotal arm 50 has a cylindrical body 58, see FIG. 5 with a passage 52 that extends from a first end 58*a* to a second end 58*b*. The cylindrical body 58 is made up of a first member 57*a*, a second member 57*b* and a third member 57*c* with passage 52 extending from the first end 58*a* to the second end 58*b*. The second member 57*b* has first 60*a* and second 60*b* collars that respectively surround and seal the openings from the first 28*a* and second 28*b* inwardly projecting members while connecting passage 52 with the source of vacuum V and yet allow the first 60*a* and second 60*b* collars to freely rotate on the first 28*a* and second 28*b* inwardly projection members.

Figure 4:
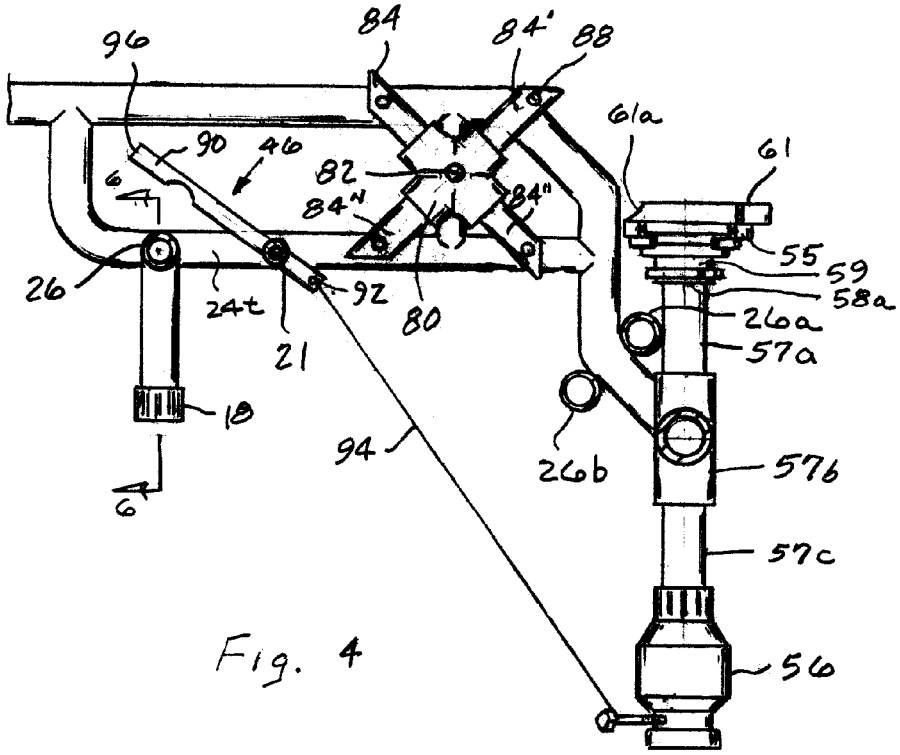
FIG. 4 is a view taken along lines 4—4 of FIG. 3.

Cone 54, see FIGS. 3,4,5, is defined by a flexible bellows 55 with a first end 59 that is fixed to the first end 58*a* of cylindrical body 58 and a second end 61 that essentially has an circular shape with a diameter that is smaller that the diameter of a volleyball 100. The cone 54 has an entrance taper that extends from apex 61*a* toward points 61' on the second end 61.

Figure 5A:
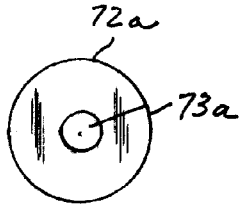
FIGS. 5*a* and 5*b* are top views of first and second caps associated with the valve in FIG. 5 that may be selected to control the flow of air into a passage in a pivotal arm.
Figure 5B:
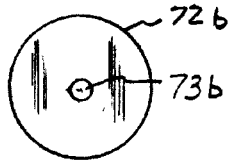

Valve 56, see FIG. 5, has a cylindrical body 64 that is attached to the second end 58*b* of the cylindrical body 58. Body 64 has an axial bore 65 with a seat 66 located between a first end and a second end. A diaphragm or poppet member 68 is located in the axial bore 65 and is urged toward seat 66 by a spring 70. The strength of spring 70 determines a force that is required to move the face of the poppet member 68 away from seat 66 and all communication of air from the surrounding environment into passage 52. A cap 72 with an opening 73 may be attached to the second end of cylindrical body 64 to define the size or diameter of the flow path from the surrounding environment into passage 52. As shown in FIGS. 5*a* and 5*b*, caps 72*a* and 72*b* have different size openings 73*a* and 73*b* that could be attached to the cylindrical body 64 to adjust the volume of air flow into passage. The cylindrical body 64 is selected to have sufficient weight such that when the arm 50 is at rest it will be located in a substantially vertical position with respect to base 26 of chute 20 as section 57*a* of cylindrical body 58 engages cross tube member 26*a*.

It is envisioned that the function of valve 56 could be performed in the following manner by restricting the flow of air from passage 52 such that as the pivotal arm 50 rotates from a vertical position to a position for striking passage 52 would be correspondingly closed. However, in such an arrangement a weight would need to be attached to the second end 58*b* to provide for the vertical alignment of the arm 50 when in the rest position.

Figure 7:
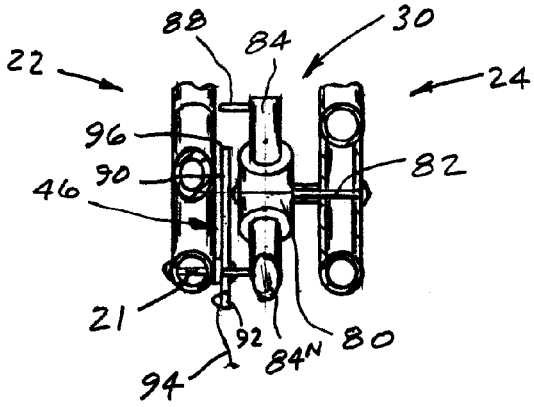
FIG. 7 is sectional view taken along lines 7—7 of FIG. 3.

The indexing member 30, see FIGS. 3,4 and 7, has an axial hub 80 that is mounted on axle 82 that extends from the second side wall 24 and a plurality of radial spokes 84,84' . . . 84$^n$ that extend there from to define a corresponding plurality of retainers for sequentially receiving volleyballs 100, 100' . . . 100$^n$ from chute 20. The radial spokes 84, 84' . . . 84$^n$ on hub 80 are aligned in a same plane as arm 50 that is essentially mid-way between the first 22 and second 24 sidewalls and free to rotate as hub 80 moves on axle 82. A stop 88 is attached to each radial spokes 84,84' . . . 84$^n$ and designed to be selectively be engaged by a locking member 46 to control or limit the rotation of hub 80. The locking member 46, see FIGS. 4 and 7, includes a lever 90 that is pivotally attached to pin 21 that extends from the first side wall 22. Lever 90 has a first end 92 that is connected by linkage 94 to the second end 58*b* or valve 54 on arm 50 and a second end 96. The second end 96 is further away from pin 21 than the first end 92 and as a result lever 90 pivots on pin 21 such that end 96 engages base 26 and aligns end 92 with a stop 88 on a radial spoke 84,84' . . . 84$^n$.

MODE OF OPERATION OF THE INVENTION

In order to begin practice of striking a volleyball 100 using the apparatus 10 for an individual, a first step is to make sure that chute 20 is located in a plane with respect to the floor F such that a volleyball may freely roll from the storage basket defined by hoop 25. To check this feature, a volleyball 100 is placed in the storage basket and allowed to roll on the top tubes defined by side walls 22 and 24 toward the indexing member 30. If the speed at which the volleyball 100 rolls is not acceptable, screws 16' in base 14 may be adjusted to a desire manner such that chute 20 has a desired slope with respect to the floor F. Once this first adjustment has been made it should be acceptable until the apparatus is moved to a floor at a different location. However, the second adjustment would be made for each individual as it is a function of the height of a person that is being taught the process of optimum striking a volleyball as the height of the chute 20 needs to be adjusted for the person as it will be different for a person that is 5' tall than for a person 6'6". This second adjustment is achieved by adjusting the height of pole 12 through compression adjustment 18 such that a volleyball 100 when located in a strike position above the net N is at a desired height for the individual. The base 14 of the apparatus 10 is located on the side of the net N corresponding to whether a person is right handed or left handed.

Figure 6:
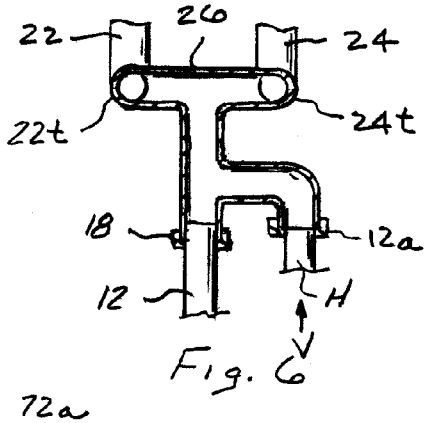
FIG. 6 is a sectional view taken along lines 6—6 of FIG. 4.

Once the apparatus 10 is set for a person, vacuum is connected to chute 20 by attaching hose H to coupling 12*a*, see FIG. 6, such that air is drawn from the surrounding environment through cone 54, passage 52, tube 22*t* of side wall 22 and tube 24*t* of side wall 24 and the cross tube of base 26. The spring 70 on valve 56 is such that in this situation poppet member 68 is retained on seat 66 and essentially all air flow resulting from the vacuum occurs through the second end 61 of cone 54. The components of apparatus 10 in this situation as illustrated in FIGS. 1, 2 and 4.

Figure 10:
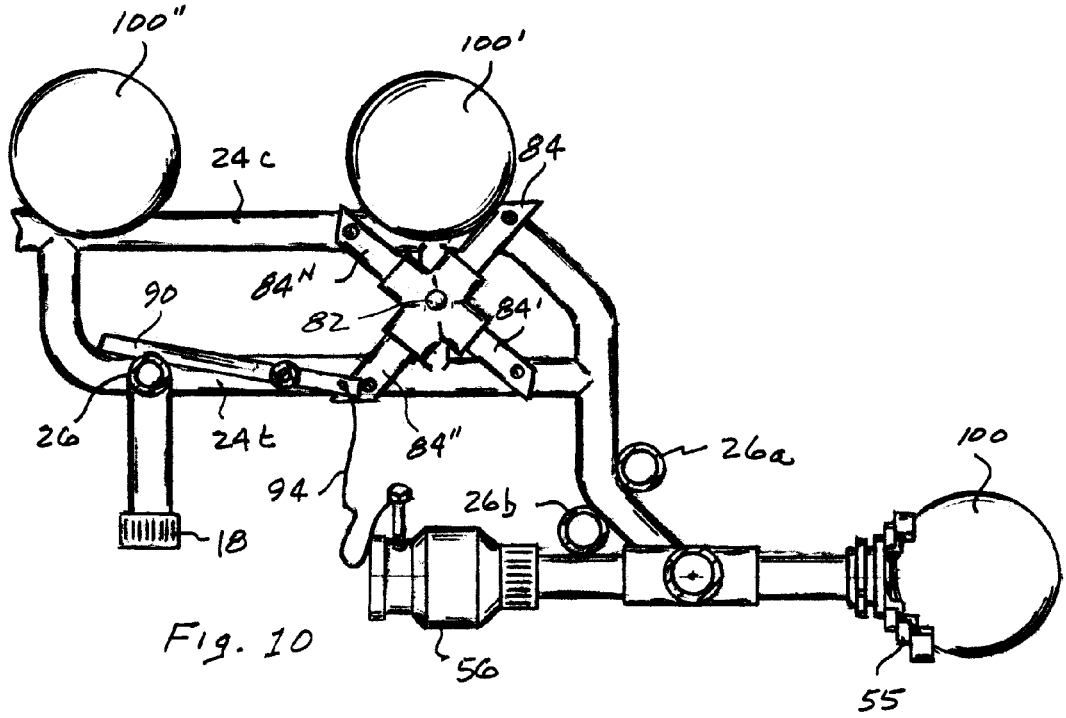
FIG. 10 is a sequential view of the apparatus of FIG. 9 wherein the pivotal arm has moved to a location where a player may swing and strike a volleyball according to a desired technique.
Figure 8:
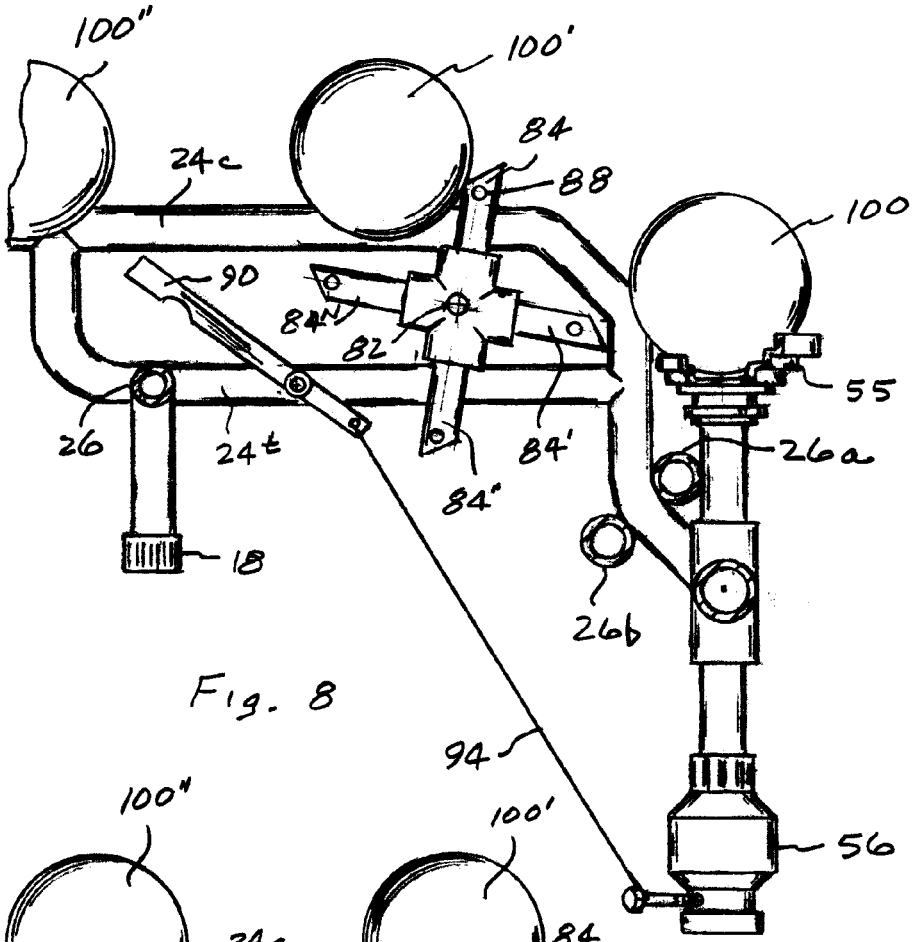
FIG. 8 is a view of FIG. 4 with a volleyball secured to a cone on an end of the pivotal arm that is located in a vertical position.

To start supplying volleyballs 100 to the person and initiate the practice, a plurality of volleyballs 100,100' . . . 100" are placed in the storage basket 25. The first volleyball 100 is directed by guides onto the chute 20 and rolls along the top tubes 22*c* and 24*c* and engages a spoke 84 on the indexing member 30. Since arm 50 is in the vertical position, on engagement with spoke 84, the volleyball 100 acts on spoke 84 to rotates hub 80 on axle 82 and continues toward the first end of chute 20 until engaging the entrance taper on second end 61 of cone 54. When the volleyball 100 contacts the engagement taper vacuum acts on and draws or sucks the volleyball onto the cone 54 with an initial force such that the surface on the volleyball engages rib 55*a* on the flexible bellows 55 to seal the second end 61 of the cone 54 from the surrounding environment. At this point in time, the initial force holding the volleyball 100 on the cone 54 is high such that the vacuum acts on poppet 68 to overcome spring 70 and draws air to be drawn into passage 52 such that the holding force on the volleyball 100 on the cone 54 is lowered as a function of the size of the opening in end cap 73. Once a volleyball 100 is secured to the cone 54, and since the weight of the volleyball 100 being greater that that of valve 56, arm 50 rotate from a vertical position as illustrated in FIG. 8 toward a position for striking as illustrated in FIG. 10. The arm 50 remains in this position as section 57*c* of cylindrical body 58 engages tube 26*a* of the base 26.

Figure 9:
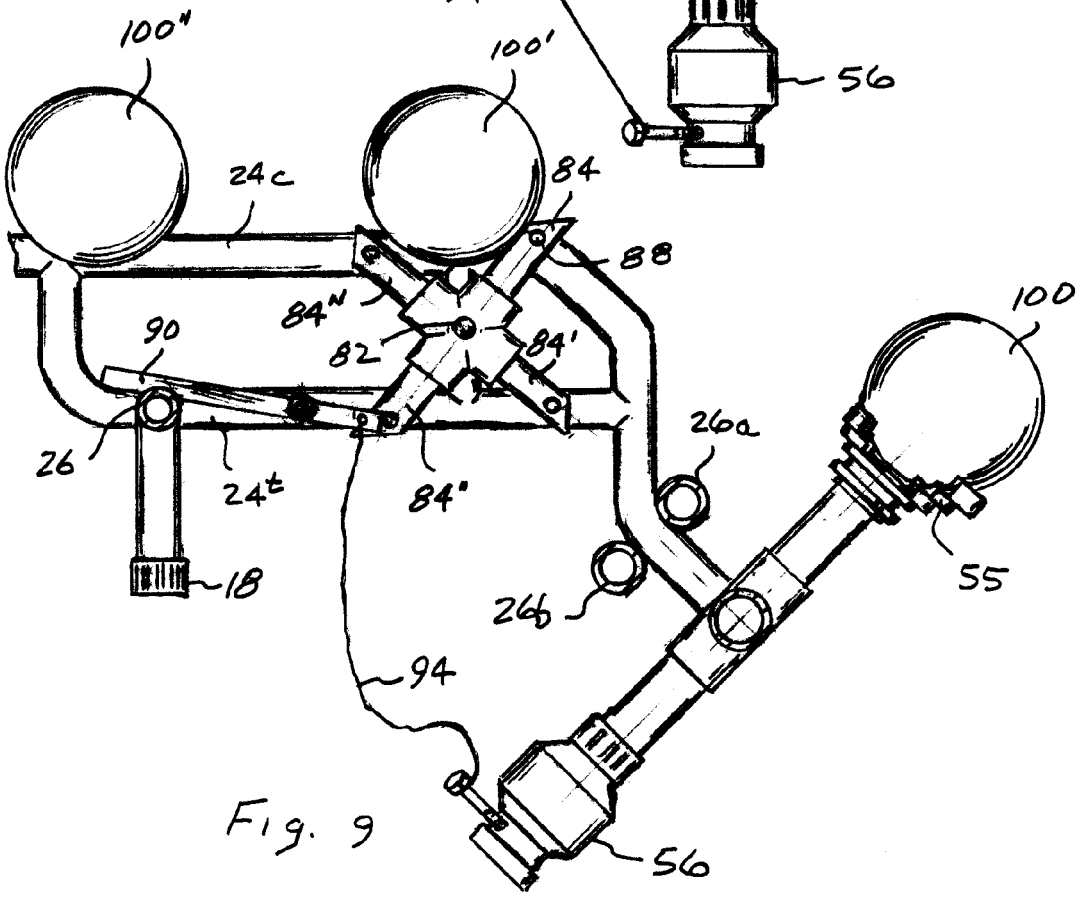
FIG. 9 is a sequential view of the apparatus of FIG. 8 wherein the pivotal arm has moved from an initial location and an indexing mechanism is locked in a fixed position to hold a volleyball in a ready position in a chute.

Once arm 50 begins to rotate from the vertical position illustrated in FIG. 8, linkage 94 changes from being taut to slack as illustrate in FIG. 9 and as a result lever 90 pivots on pin 21 and end 96 engages the cross tube of base 26 such that end 92 becomes an abutment for stop 88 on spoke 84" to hold the hub 80 on indexing member 30 in a stationary position with a volleyball 100' in a ready position as shown in FIG. 9. In the position to strike as illustrated in FIG. 10, the volleyball 100 is located such that a person may swing in a manner that the applied contact occurs from above the top of the volleyball without being obstructed by the cone 54.

The force holding the volleyball 100 to the cone 54 may be adjusted by changing air flow through the second end 58*b* of the arm by selecting an end cap 72*a* or 72*b* to meet the person's current training but in most instances the holding force should be minimal.

Once a volleyball 100 has been struck, the weight of the valve 56 causes the arm 50 to return to the vertical position with member 57*a* of the cylindrical body 58 engaging cross tube 26*a* and the sequence of a volleyball 100' being released from the indexing member 30, rolling onto the cone 54 and being retained thereon by a vacuum holding force and a sequential volleyball 100" being retained in the indexing member 30 continues until the supply of volleyball loon is exhausted.

What is claimed is:

1. An apparatus for allowing a person to practice spiking a volleyball comprising:

a support;

a chute having parallel first and second side walls that are connected to a base that is attached to said support, said first side wall having a first end and second end with a first inwardly projecting member extending from said first end, said second side wall having a third end and a fourth end with a second inwardly projecting member extending from said third end;

an arm having a body with a passage that extends from a first end and a second end including a collar that surrounds said first and second inwardly projecting members to connect said passage with a corresponding passage in at least one of said first and second side walls, said collar in surrounding said first and second inwardly projection members allowing said body to pivot about said first and second inwardly projection members;

a cone secured to the first end of said body;

a valve attached to the second end of said body, said valve having sufficient weight such that at rest said arm is located in a substantially vertical position with respect to said base;

a source of vacuum connected to said body for drawing air through said passage from the surrounding environment by way of said cone and valve;

indexing means for retaining a volleyball in said chute; and actuation means for allowing a volleyball to move from said indexing means toward the first end of said chute and onto said cone such that said vacuum pulls on and holds said volleyball on said cone, said cone with a volleyball attached thereto having a greater weight than said valve and as a result said arm pivots on said first and second inwardly projections and said volleyball is moved from the position of rest for said arm to a position where a player may spike the volleyball.

2. The apparatus as recited in claim 1 wherein said valve is characterized by means to control the flow of air into said passage such that with the arm in the position of rest essentially all air flow into said passage occurs through said cone.

3. The apparatus as recited in claim 2 wherein said means for said valve is characterized by a poppet member that is urged toward and into engagement with a seat by a spring, said vacuum overcoming the force of said spring and allows air to flow into said passage when said volleyball is positioned on said cone.

4. The apparatus as recited in claim 3 wherein said spring is selected to define a minimum force by which said volleyball is held on said cone.

5. The apparatus as recited in claim 2 wherein said cone is characterized by a flexible bellows having a first end that is fixed to the first end of said body and a second end that has a shape with a smaller diameter than a diameter of a volleyball.

6. The apparatus as recited in claim 5 wherein said second end of said cone has an entrance taper such that when a volleyball approaches the first end of said chute, the volleyball initially engages said entrance taper and is thereafter brought into sealing engagement with a cylindrical rib on said second end of said cone.

7. The apparatus as recited in claim 1 further characterized by linkage responsive to provide said indexing means with an input on movement of said arm to allow a subsequent volleyball located in a storage section on said second end of said chute to move into a ready position adjacent said first end of said chute.

8. The apparatus as recited in claim 7 wherein said indexing means including an axial hub fixed to said second side wall, said axial hub having a plurality of radial spokes that extending there from to define a corresponding plurality of retainers that sequentially receive volleyballs from said chute.

9. The apparatus as recited in claim 8 wherein said indexing means is further defined by said radial spokes being aligned in a radial plane with said arm to assist said first and second side walls presenting a volleyball to said cone.

10. The apparatus as recited in claim 9 further including locking means that respond to movement of said arm from said vertical position by permitting said axial hub to rotate and allow a volleyball in a retainer thereon to roll toward said first end of said chute and said cone.

11. The apparatus as recited in claim 10 wherein said locking means includes a lever pivotally attached to said first side wall and a stop located on each of said plurality of spokes, said lever having a first end connected to said linkage such that when said arm is in a vertical position said first end of said lever engages a stop to prevent said axial hub from rotating and thereby hold a volleyball in a retainer.

12. The apparatus as recited in claim 11 wherein said storage section on the second end of said side walls includes guides for aligning a single volleyball in said radial plane.

13. The apparatus as recited in claim 1 wherein said support includes first adjustment means for selectively positioning said base with respect to a floor.

14. The apparatus as recited in claim 13 wherein said support means further includes second adjustment means for aligning said base with respect to said floor such that a volleyball may roll from said second end toward said first end of said first and second side walls.

* * * * *